US010680331B2

(12) United States Patent
Kyllonen et al.

(10) Patent No.: US 10,680,331 B2
(45) Date of Patent: Jun. 9, 2020

(54) ANTENNA WITH REVERSING CURRENT ELEMENTS

(71) Applicant: Carrier Corporation, Jupiter, FL (US)

(72) Inventors: Kimmo Antero Kyllonen, Shakopee, MN (US); Jeffrey Oramel Brown, St. Paul, MN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 183 days.

(21) Appl. No.: 15/572,880

(22) PCT Filed: May 4, 2016

(86) PCT No.: PCT/US2016/030642

§ 371 (c)(1),
(2) Date: Nov. 9, 2017

(87) PCT Pub. No.: WO2016/182801

PCT Pub. Date: Nov. 17, 2016

(65) Prior Publication Data

US 2018/0123252 A1 May 3, 2018

Related U.S. Application Data

(60) Provisional application No. 62/159,787, filed on May 11, 2015.

(51) Int. Cl.
*H01Q 9/30* (2006.01)
*H01Q 5/314* (2015.01)
(Continued)

(52) U.S. Cl.
CPC ..... *H01Q 5/314* (2015.01); *H01Q 5/321* (2015.01); *H01Q 5/328* (2015.01); *H01Q 9/42* (2013.01)

(58) Field of Classification Search
CPC ..... H01Q 5/321; H01Q 5/328; H01Q 5/314; H01Q 9/42
See application file for complete search history.

(56) References Cited

U.S. PATENT DOCUMENTS 5,072,233 A 12/1991 Zansig
6,104,354 A 8/2000 Hill et al.
(Continued)

FOREIGN PATENT DOCUMENTS

EP 2209160 A1 7/2010
EP 2234205 A1 9/2010
(Continued)

OTHER PUBLICATIONS

Chong, Y.I. and Wenbin, Dou, Microstrip Series Fed Antenna Array for Millimeter Wave Automotive Radar Applications, 2012 IEEE MTT-S International Microwave Workshop Series on Millimeter Wave Wireless Technology and Applications, 2012, pp. 1-3, IEEE Conference Publications, New York.
(Continued)

*Primary Examiner* — Ab Salam Alkassim, Jr.
(74) *Attorney, Agent, or Firm* — Cantor Colburn LLP

(57) ABSTRACT

An antenna assembly including a first conductive element including a first Q-value and a first impedance value, a second conductive element including a second Q-value and a second impedance value, and a current reversing element in communication with the first conductive element and the second conductive element.

11 Claims, 1 Drawing Sheet

(51) Int. Cl.

| | |
|---|---|
| ***H01Q 5/321*** | (2015.01) |
| ***H01Q 5/328*** | (2015.01) |
| ***H01Q 9/42*** | (2006.01) |

(56) References Cited

U.S. PATENT DOCUMENTS

| | | | | |
|---|---|---|---|---|
| 6,597,315 | B2 | 7/2003 | Yokoshima et al. | |
| 6,809,687 | B2 | 10/2004 | Yuanzhu | |
| 6,819,290 | B2 | 11/2004 | Hani et al. | |
| 6,873,291 | B2 | 3/2005 | Aoyama et al. | |
| 7,034,752 | B2 | 4/2006 | Sekiguchi et al. | |
| 7,106,253 | B2 | 9/2006 | Yuanzhu | |
| 7,119,749 | B2 | 10/2006 | Miyata et al. | |
| 7,548,138 | B2 | 6/2009 | Kamgaing | |
| 7,786,940 | B2 | 8/2010 | Hirano | |
| 8,063,830 | B2 | 11/2011 | Yoshioka et al. | |
| 8,279,133 | B2 | 10/2012 | Shimoda et al. | |
| 8,466,844 | B2 * | 6/2013 | Ying | H01Q 1/243 343/700 MS |
| 8,547,283 | B2 * | 10/2013 | Wong | H01Q 1/243 343/700 MS |
| 8,564,485 | B2 | 10/2013 | Milosavljevic et al. | |
| 8,643,557 | B2 * | 2/2014 | Nakano | H01Q 1/243 343/744 |
| 8,736,509 | B2 * | 5/2014 | Shoji | H01Q 5/00 343/860 |
| 9,088,067 | B2 * | 7/2015 | Wong | H01Q 1/243 |
| 9,660,343 | B2 * | 5/2017 | Ryu | H01Q 5/328 |
| 10,122,086 | B2 * | 11/2018 | Kuroda | H01Q 5/321 |
| 10,290,940 | B2 * | 5/2019 | Toh | H01Q 9/0442 |
| 2005/0078037 | A1 * | 4/2005 | Leclerc | H01Q 1/243 343/702 |
| 2005/0190107 | A1 * | 9/2005 | Takagi | H01Q 1/243 343/702 |
| 2007/0268191 | A1 * | 11/2007 | Ishizuka | H01Q 1/243 343/702 |
| 2011/0273354 | A1 | 11/2011 | Davidson | |
| 2011/0309986 | A1 * | 12/2011 | Ying | H01Q 1/243 343/752 |
| 2012/0001815 | A1 * | 1/2012 | Wong | H01Q 1/243 343/749 |
| 2013/0021211 | A1 | 1/2013 | Komaki et al. | |
| 2013/0135164 | A1 | 5/2013 | Asanuma et al. | |
| 2013/0229320 | A1 | 9/2013 | Asanuma et al. | |
| 2013/0234902 | A1 | 9/2013 | Asanuma et al. | |
| 2013/0278480 | A1 * | 10/2013 | McMilin | H01Q 1/243 343/904 |
| 2014/0015729 | A1 * | 1/2014 | Uejima | H01Q 9/14 343/850 |
| 2014/0125536 | A1 * | 5/2014 | Wong | H01Q 1/243 343/749 |
| 2014/0292602 | A1 * | 10/2014 | Suzuki | H01Q 1/243 343/749 |
| 2015/0123855 | A1 * | 5/2015 | Ryu | H01Q 5/328 343/702 |
| 2015/0236417 | A1 * | 8/2015 | Iellci | H01Q 1/243 343/850 |

FOREIGN PATENT DOCUMENTS

| | | | |
|---|---|---|---|
| EP | 2405533 | A1 | 11/2012 |
| EP | 2728665 | A1 | 5/2014 |

OTHER PUBLICATIONS

European Patent Office, International Search Report for PCT/US2016/030642, dated Jul. 28, 2016.

European Patent Office, Written Opinion of the International Searching Authority for PCT/US2016/030642, dated Jul. 28, 2016.

European Office Action for application EP 16723211.5, dated Sep. 2, 2019, 30 pages.

* cited by examiner

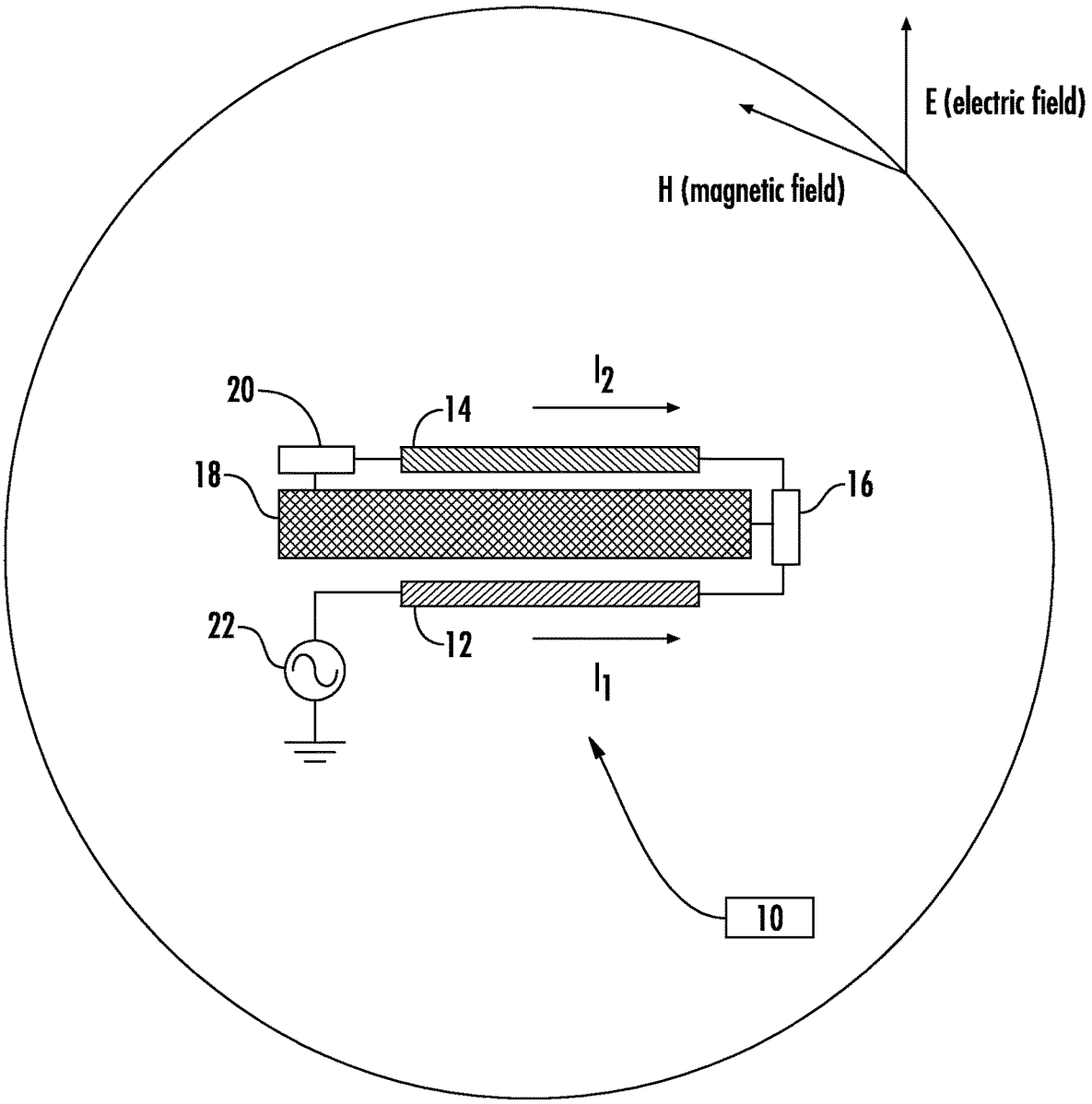
E (electric field)
H (magnetic field)
20
14
$I_2$
18
16
22
12
$I_1$
10

ANTENNA WITH REVERSING CURRENT ELEMENTS

CROSS-REFERENCE TO RELATED APPLICATIONS

The present application is a U.S. national stage of, and claims the priority benefit of, International Patent Application Serial No. PCT/US2016/030642, filed May 4, 2016 and also claims the priority benefit of U.S. Application Ser. No. 62/159,787 filed May 11, 2015, the text and drawing of which are hereby incorporated by reference in their entireties.

TECHNICAL FIELD OF THE DISCLOSED EMBODIMENTS

The presently disclosed embodiments are generally related to antennas; and more particularly to an antenna with reversing current elements.

BACKGROUND OF THE DISCLOSED EMBODIMENTS

Radio frequency (RF) equipment uses a variety of approaches and structures for receiving and transmitting radio waves in selected frequency bands. Generally, physically small and electrically short antennas have issues radiating the radio waves. There is therefore a need for improvements in smaller, electrically short antenna assemblies.

SUMMARY OF THE DISCLOSED EMBODIMENTS

In one aspect, an antenna assembly is provided. The antenna assembly includes a first conductive element and a second conductive element in communication with a current reversing element. The first conductive element includes a first Q-value and a first impedance value, and the second conductive element includes a second Q-value and a second impedance value.

In an embodiment, the first Q-value of the first conductive element is greater than the second Q-value of the second conductive element. In another embodiment, the first impedance value of the first conductive element is greater than the second impedance value of the second conductive element.

In an embodiment, the first conductive element and/or the second conductive element may be composed of a metallic conductor. In an embodiment, a portion of the first conductive element is positioned substantially parallel to the second conductive element. In an embodiment, the current reversing element includes an inductive component.

The antenna assembly further includes a third conductive element in communication with the current reversing element. In an embodiment, the third conductive element comprises a ground plane. In another embodiment, a portion of the second conductive element is positioned substantially coplanar to and located adjacent to the third conductive element.

The antenna assembly further includes a tuning element in communication with the second conductive element and the third conductive element. In an embodiment, the tuning element includes a capacitive component.

In another embodiment, any of the second conductive element, current reversing element, third conductive element, and tuning element may be disposed on a dielectric substrate. In the embodiment where the second conductive element is disposed on a dielectric substrate, the first conductive element is positioned substantially perpendicular to and extends from the dielectric substrate.

BRIEF DESCRIPTION OF DRAWINGS

FIG. 1 illustrates a schematic diagram of an antenna assembly according to at least one embodiment of the present disclosure.

DETAILED DESCRIPTION OF THE DISCLOSED EMBODIMENTS

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a schematic diagram of the antenna assembly 10 according to one embodiment. The antenna assembly 10 includes a first conductive element 12 and a second conductive element 14 in communication with a current reversing element 16. The first conductive element 12 includes a first Q-value and a first impedance value, and the second conductive element 14 includes a second Q-value and a second impedance value. The Q-value of an antenna is a measure of the bandwidth of an antenna relative to the center frequency of the bandwidth. It will be appreciated that the resonant frequency of the antenna assembly 10 may be dependent on a length of the second conductive element 14 (i.e. the shorter the length of the second conductive element 14, the higher the frequency).

In an embodiment, the first Q-value of the first conductive element 12 is greater than the second Q-value of the second conductive element 14. In another embodiment, the first impedance value of the first conductive element 12 is greater than the second impedance value of the second conductive element 14. For example, to optimize the performance of the antenna assembly, the ratio between the first Q-value of the first conductive element 12 and the second Q-value of the second conductive element 14 may be slightly larger than 1:1. Additionally, the ratio between the first impedance value and the second impedance value may be slightly larger than 1:1.

In an embodiment, the first conductive element 12 and/or the second conductive element 14 may be composed of a metallic conductor. For example, the first conductive element 12 may be composed of a wire loop, a sheet metal strip, or a wire helix to name a few non-limiting examples, and the second conductive element 14 may be composed of a copper wire, to name one non-limiting example. In an embodiment, a portion of the first conductive element 12 is positioned substantially parallel to the second conductive element 14.

In an embodiment, the current reversing element 16 includes an inductive component. The current reversing element 16 is configured to assist in the matching of a radio frequency to optimize the antenna assembly 10. The current reversing element 16 may comprise a chip inductor, air coil inductor, or a metallic conductor (e.g. a wire loop, wire helix, or metal strip) to name a few non-limiting examples.

The antenna assembly 10 further includes a third conductive element 18 in communication with the current reversing element 16. In an embodiment, the third conductive element 18 comprises a ground plane. For example, the third conductive element 18 may include a case, a base, a mounting bracket, a plastic piece with conductive plating, etc. to name a few non-limiting examples. It will also be appreciated that the shape and size of the third conductive element 18 may affect the performance for the antenna assembly 10. In another embodiment, a portion of the second conductive element 14 is positioned substantially coplanar to and located adjacent to the third conductive element 18.

The antenna assembly 10 further includes a tuning element 20 in communication with the second conductive element 14 and the third conductive element 18. In an embodiment, the tuning element 20 includes a capacitive component. The tuning element 20 is configured for tuning the antenna frequency, and may be composed of a chip capacitor, and an interdigital capacitor to name a few non-limiting examples.

In another embodiment, any of the second conductive element 14, current reversing element 16, third conductive element 18, and tuning element 20 may be disposed on a dielectric substrate. For example, the second conductive element 14, current reversing element 16, third conductive element 18, and tuning element 20 may each comprise a trace on a dielectric substrate to name one non-limiting example. The tuning element 20 may include a gap between the second conductive element 14 and the third conductive element 18 to name one non-limiting example. In the embodiment where the second conductive element 14 is disposed on a dielectric substrate, the first conductive element 12 is positioned substantially perpendicular to and extends from the dielectric substrate. It will also be appreciated that a portion of the antenna assembly 10 may be mounted in an antenna mounting region (not shown) provided on one principal surface (e.g. an upper surface) of the dielectric substrate.

During operation of the antenna assembly 10, a radio frequency source 22 is placed in communication with the first conductive element 12 to induce a first current, designated as $I_1$, on the first conductive element 12. As the first current flows through the first conductive element 12, current reversing element 16 induces a second current, designated as 12, on the second conductive element 14. Generally, the currents on the first conductive element 12 and the second conductive element 14 would be reversed; however, since the signal path is bent by 180 degrees, the currents flow in the same direction, as indicated in FIG. 1. A time changing (i.e. sinusoidal) current such the first current $I_1$ radiates an electromagnetic field. This electromagnetic field expands outward from the antenna assembly 10. This outward expansion is illustrated by an electric field E and a magnetic field H. The time changing (i.e. sinusoidal) second current $I_2$ radiates a similar electromagnetic field as the first current I1. As such, the electromagnetic fields from $I_1$ and $I_2$ will superimpose upon each other; thus doubling the size of the electromagnetic fields.

It will therefore be appreciated that the present embodiments provide improvements in smaller, shorter antennas by including a current reversing element 16 to control the directional flow of the first and second currents $I_1$ and $I_2$ in the same direction; thus, increasing the strength of the resulting electromagnetic field and optimizing antenna performance for small volume antennas without a significant cost impact.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An antenna assembly comprising:

a first conductive element including a first Q-value and a first impedance value;

a second conductive element including a second Q-value and a second impedance value; and a current reversing element connected to the first conductive element and the second conductive element;

a third conductive element connected to the current reversing element; and a tuning element connected to the second conductive element and the third conductive element;

wherein the second conductive element, the third conductive element, the tuning element, and the current reversing element are disposed on a dielectric substrate;

wherein the first conductive element is substantially perpendicular to and extends from the dielectric substrate.

2. The assembly of claim 1, wherein the current reversing element comprises an inductive component.

3. The assembly of claim 1, wherein the tuning element comprises a capacitive component.

4. The assembly of claim 1, wherein a portion of the first conductive element is positioned substantially parallel to the second conductive element.

5. The assembly of claim 1, wherein a portion of the second conductive element is positioned substantially coplanar to and located adjacent to the third conductive element.

6. The assembly of claim 1, wherein the first Q-value is greater than the second Q-value.

7. The assembly of claim 1, wherein the first impedance value is greater than the second impedance value.

8. The assembly of claim 1, wherein the first conductive element comprises a metallic conductor.

9. The assembly of claim 1, wherein the third conductive element comprises a ground plane.

10. The assembly of claim 1, wherein the current reversing element is directly connected to the first conductive element and directly connected to the second conductive element; the third conductive element is directly connected to the current reversing element; and the tuning element is directly connected to the second conductive element and directly connected to the third conductive element.

11. An antenna assembly comprising:

a radio frequency source;

a first conductive element including a first Q-value and a first impedance value, the first conductive element having a first end connected to the radio frequency source;

a current reversing element connected to a second end of the first conductive element;

a second conductive element including a second Q-value and a second impedance value, the second conductive element having a first end connected to the current reversing element;

a third conductive element having a first end connected to the current reversing element; and a tuning element having a first end connected to a second end of the third conductive element and a second end connected to a second end of the second conductive element.

* * * * *